US007490655B2

(12) United States Patent
Lamberti et al.

(10) Patent No.: US 7,490,655 B2
(45) Date of Patent: Feb. 17, 2009

(54) DEVICE FOR THE SUPPORT AND OSCILLATION OF A CONTINUOUS CASTING MOULD FOR CASTING LIQUID METAL, PARTICULARLY LIQUID STEEL

(75) Inventors: Thomas Lamberti, Düsseldorf (DE); Axel Stavenow, Düsseldorf (DE); Jörn Hoffmeister, Moers (DE); Jürgen Müller, Kaarst (DE); Axel Weyer, Wuppertal (DE)

(73) Assignee: SMS Demag AG, Düsseldorf (DE)

( * ) Notice: Subject to any disclaimer, the term of this patent is extended or adjusted under 35 U.S.C. 154(b) by 81 days.

(21) Appl. No.: 11/630,466

(22) PCT Filed: Jun. 16, 2005

(86) PCT No.: PCT/EP2005/006473

§ 371 (c)(1),
(2), (4) Date: Dec. 21, 2006

(87) PCT Pub. No.: WO2006/002771

PCT Pub. Date: Jan. 12, 2006

(65) Prior Publication Data

US 2007/0295474 A1 Dec. 27, 2007

(30) Foreign Application Priority Data

Jul. 6, 2004 (DE) ..... 10 2004 032 764
Apr. 14, 2005 (DE) ..... 10 2005 017 226

(51) Int. Cl.
*B22D 11/04* (2006.01)
*B22D 11/053* (2006.01)

(52) U.S. Cl. ..... 164/416; 164/478

(58) Field of Classification Search ..... 164/478, 164/416

See application file for complete search history.

(56) References Cited

U.S. PATENT DOCUMENTS 6,889,748 B2 * 5/2005 Fischer et al. ..... 164/416

FOREIGN PATENT DOCUMENTS

DE 101 31 715 1/2003
DE 102 44 596 4/2004

* cited by examiner

*Primary Examiner*—Kuang Lin
(74) *Attorney, Agent, or Firm*—Friedrich Kueffner

(57) ABSTRACT

A device for the support and oscillation of a continuous casting mould (1) for casting liquid metal, particularly liquid steel, comprising guide elements (4) which are mounted on fixed carrier components (5) and which is actually by means of oscillation devices (6). In order to shorten time required for mounting and dismounting and therefor to lower the down times and costs of said continuous casting device, a first module (7) is made of guide elements (4) and carrier components (5) and a second module (8) consists of the oscillation device (6). The second module (8) can be dismantled via an outlet (9) which extends laterally, perpendicular to the plane of symmetry (2) below the guide elements (4) or in between guide elements (4). Each of the two modules (7,8) can be dismounted or re-mounted in a manner which is temporally and locally independent from the other respective module (7,8).

2 Claims, 4 Drawing Sheets

DEVICE FOR THE SUPPORT AND OSCILLATION OF A CONTINUOUS CASTING MOULD FOR CASTING LIQUID METAL, PARTICULARLY LIQUID STEEL

BACKGROUND OF THE INVENTION

The invention concerns a device for supporting and oscillating a continuous casting mold for casting molten metal, specially molten steel.

Devices of this type move large masses, which consist of the weight of the continuous casting mold with sidewalls (narrow-side plates), a support structure for the sidewalls and for water tanks, a mold frame with guide elements arranged on both sides, and oscillation drives. In addition, there is the frictional force between the surfaces of the cast strand and the mold walls during the downstroke of the oscillation drives. All together, the supporting installations for devices of this type are very heavy and, in addition, require a large amount of space, so that accessibility to the parts and assemblies that are subject to wear is complicated. However, the dismounting or mounting of parts that need to be replaced or maintained is a tedious process that requires a long shutdown of the continuous casting machine. This results in considerable economic disadvantages.

The objective of the invention is to shorten the maintenance, dismounting, and mounting times by means of a suitable structural design and thus to reduce shutdown time and expense.

SUMMARY OF THE INVENTION

In accordance with the invention, the stated objective is achieved by virtue of the fact that a first assembly consists of guide elements and support members, and a second assembly consists of the oscillation device, wherein the second assembly can be dismounted through a lateral outlet or inlet that extends transversely to the plane of symmetry below the guide elements or between guide elements, and wherein each of the two assemblies can be dismounted or remounted independently of the other assembly with respect to time and location. This increases the accessibility to the important parts and assemblies and results in a shorter shutdown time. However, the principal advantage is realized by virtue of the fact that, regardless of whether an assembly for guide elements or the oscillation device must be changed more frequently, the shorter maintenance or changing time can be used, because a specific sequence of successive dismantling operations is no longer necessary. Furthermore, advantages are realized by virtue of the fact that an earlier dismounting or mounting operation to be carried out without maintenance does not create the necessity of realignment or readjustment of the given other type of assembly that is not involved in the dismounting, mounting, or maintenance.

One refinement of the invention is aimed at reducing the masses to be moved and thus at reducing the loads on the parts. In accordance with this refinement, the first assembly, together with extensions of a self-supporting continuous casting mold, is supported and mounted by means of the guide elements on spaced bearing blocks.

Those skilled in the art attempt to combine as many parts as possible in an assembly. To this end, it is proposed that, in the first assembly, the support members and the guide elements be combined to form a dismountable unit in such a way that bearing blocks are arranged parallel to the plane of symmetry, that the guide elements are mounted on the bearing blocks, and that the guide elements are also connected with the respective extension of the self-supporting continuous casting mold.

In accordance with further features of the invention, the number of parts can be reduced if the bearing blocks together form a single-piece wall frame and are supported and mounted in pairs on an intermediate plate.

The desired reduction of the large masses and the improvement of accessibility to the continuous casting mold and its functional groups and its water tanks and/or the narrow-side plates in the case of continuous casting molds for slabs can be further assisted if the wall frame has openings for access to the narrow side of the mold.

Especially in the case of complete absence of a mold frame or a similarly heavy frame, the assembly comprising the support members is wherein the first assembly also comprises a cover plate and a support plate with guide bars for the continuous casting mold.

In accordance with further features of the invention, the portion of the parts that it would otherwise be necessary to dismount during maintenance, dismounting, or mounting can be reduced by forming a stationary assembly, which comprises a base plate, several support walls, and an intermediate plate, and mounting it on a stationary, detachable bearing plate on the continuous casting frame.

In addition, easier accessibility of the stationary support members is realized by arranging free spaces on both sides on the intermediate plate for the oscillating movements of guide elements in the form of leaf springs.

Ultimately, even after a large number of casting operations, the total number of parts can be attached by mounting the stationary, detachable assembly by means of base bolts on the stationary bearing plate.

The dismounting or remounting of the oscillation drive, which can include pairs of oscillation devices, presupposes integration in the stationary region, and therefore the invention provides that each oscillation device is supported on a flange plate in the boundary region between the first dismountable assembly and the stationary assembly.

In order to allow easier, faster, and more complete dismounting or mounting, the invention provides that the second dismountable assembly comprises at least one oscillation device with the piston-cylinder drive and control and switching elements.

One of the regions that is excepted from dismounting or mounting during maintenance work on parts or assemblies is the cooling region of the continuous casting mold, for which a stationary mounting structure with cooling water connections is provided on the intermediate plate.

Previous designs and experience can be taken into consideration in the cooling region of the continuous casting mold in such a way that the cooling water connections are each led to a water connection plate, which is mounted on the intermediate plate.

The number of parts or assemblies to be dismounted can be increased, if necessary, in such a way that the stationary base plate and the intermediate plate with the mounting structures form a stationary, detachable assembly, which can be lifted or set down by means of lifting eyebolts.

BRIEF DESCRIPTION OF THE DRAWING

Specific embodiments of the invention are illustrated in the drawings and explained in greater detail below.

DETAILED DESCRIPTION OF THE INVENTION

Figure 1:
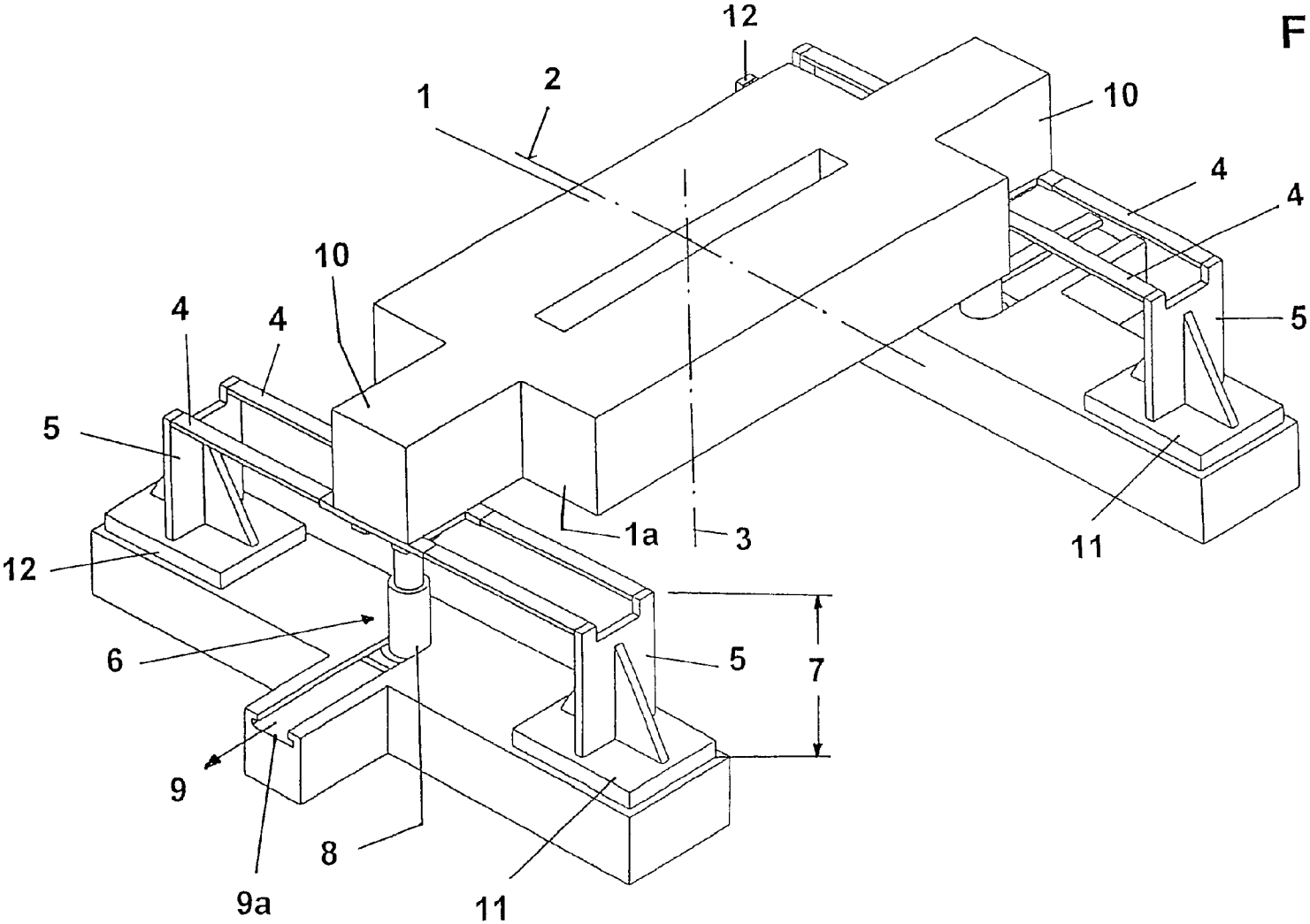
FIG. 1 is a perspective view of a continuous casting mold with assemblies for guide elements, support members, and oscillation devices installed on both sides.

The device (FIG. 1) for supporting and oscillating a continuous casting mold 1 is used for the continuous casting of molten metal, especially molten steel, with guide elements 4, which are arranged on both sides of a plane of symmetry 2 that contains the central longitudinal axis 3 of the cast strand and which can comprise excenters, steering levers, springs of any type, or, as illustrated, leaf springs. The guide elements 4 are linked to stationary support members 5, and the continuous casting mold 1 is supported on both sides on guide elements of this type and on at least one oscillation device 6 per side. Each oscillation device 6 comprises a piston-cylinder drive 6*a* (FIG. 2), control and switching means, e.g., valves, and a hydraulic circuit.

Figure 2:
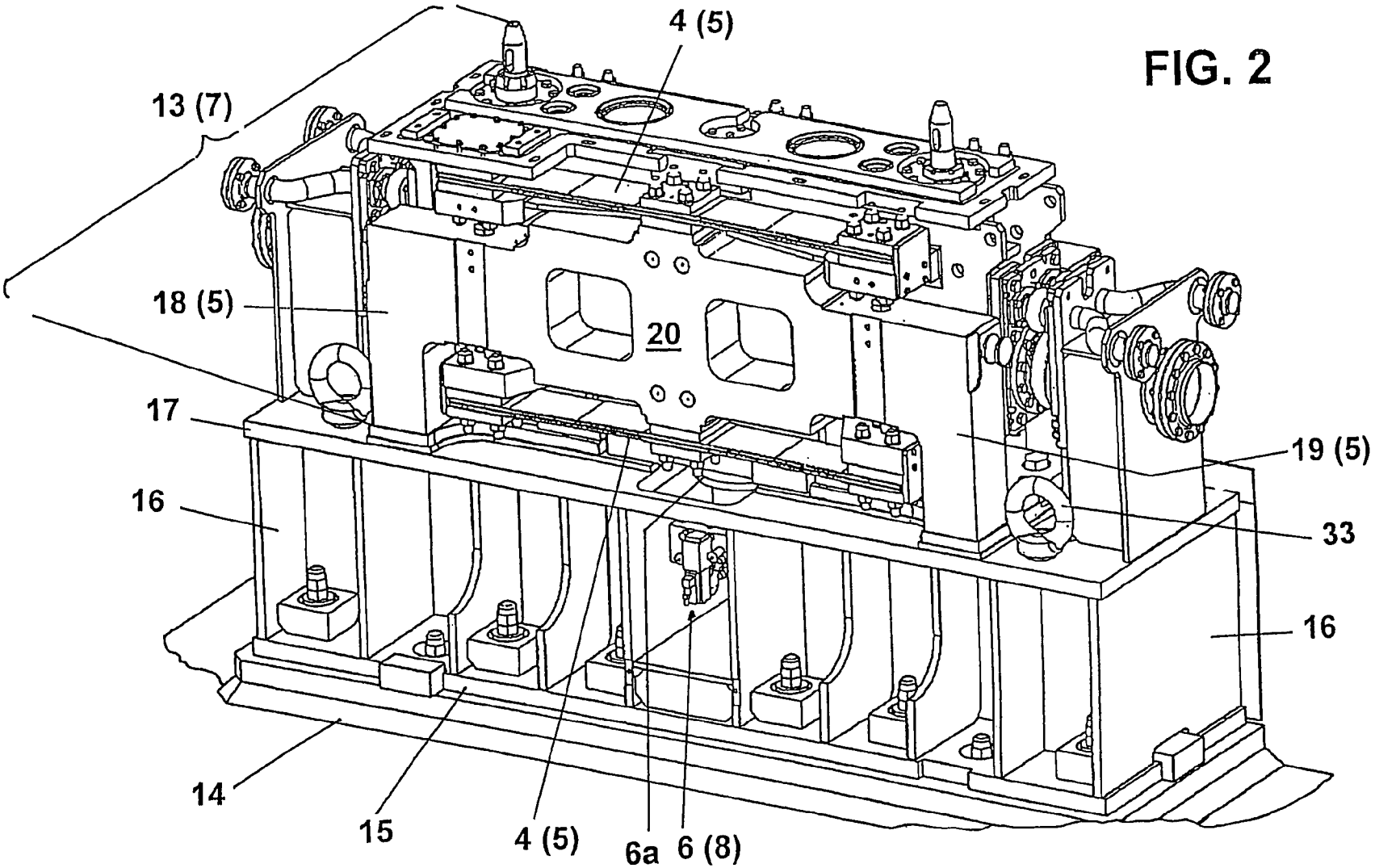
FIG. 2 is a perspective view of the stationary assembly and dismountable assemblies or parts provided on each support side for the continuous casting mold.
Figure 3:
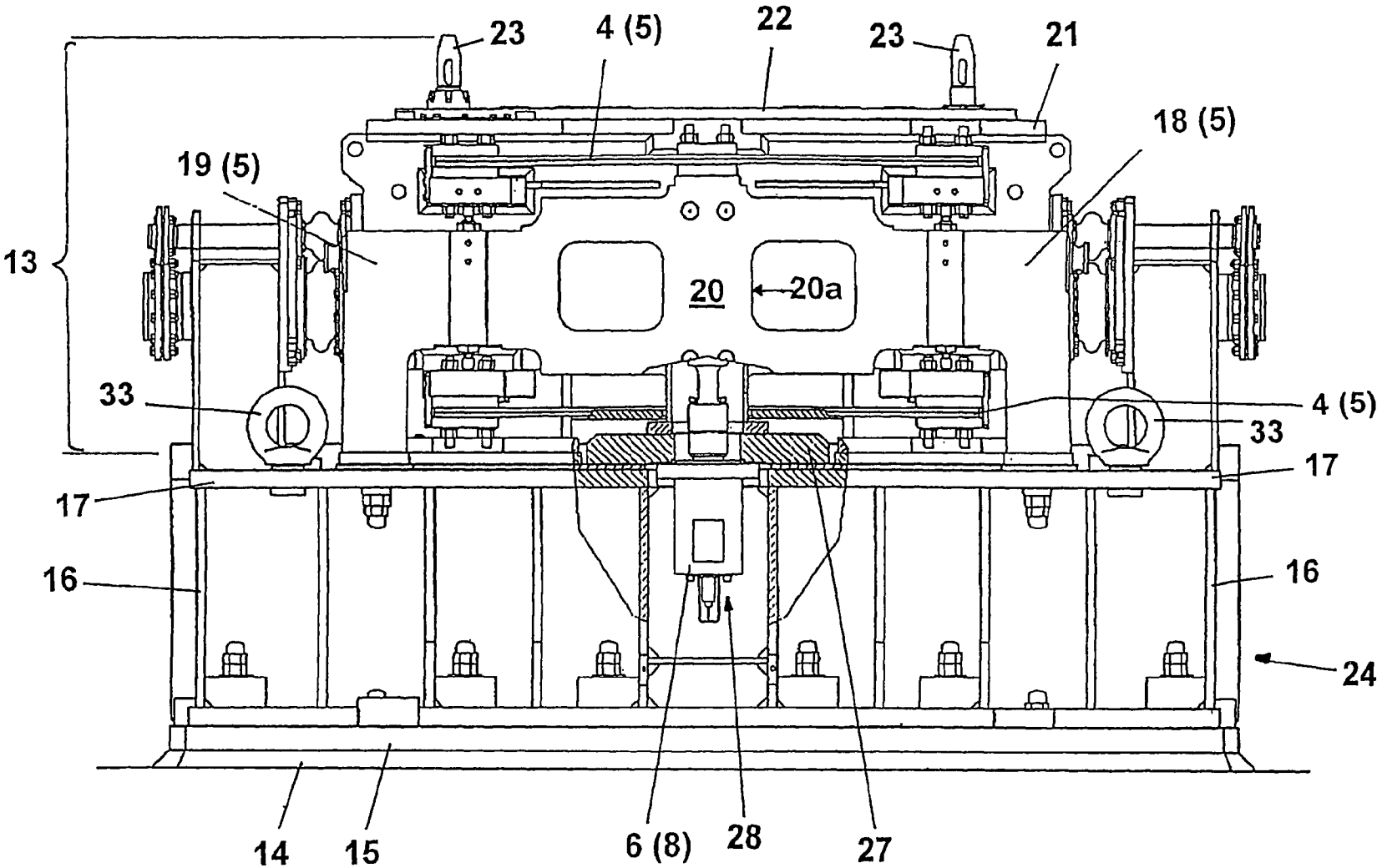
FIG. 3 is a two-dimensional view of the front longitudinal end of the device according to FIG. 2 with a partial section of the oscillation device.

According to FIGS. 1 to 3, a first assembly 7 comprises the guide elements 4 and support members 5. A second assembly 8 comprises the oscillation device 6. In accordance with a special design feature, the second assembly 8 can be dismounted or mounted through a lateral outlet 9 (or inlet) that extends transversely to the plane of symmetry 2 below the guide elements 4 or between guide elements 4. The second dismountable assembly 8 is moved with its cylinder in a laterally directed guideway 9*a* and can be serviced in a dismounted position, e.g., the cylinder or the piston of the piston-cylinder drive 6*a* can be changed. Another important feature is that each of the two assemblies can be dismounted and remounted independently of each other with respect to time and location. The first assembly 7 does not need to be removed. Conversely, the entire hydraulic supply circuit of the second assembly 8 can remain in the device and does not need to be opened if maintenance work is being performed only on the first assembly 7.

According to FIG. 1, the continuous casting mold 1 with extensions 10 is supported on the first assembly 7. The continuous casting mold 1 does not rest on a mold frame but rather rests directly on the guide elements 4 by its extensions 10.

FIG. 2 shows the detailed mounting structure of the first assembly 7. The guide elements 4, which act as support members 5, are selected as leaf spring assemblies in the illustrated embodiment and are supported centrally between bearing blocks 11 and 12 (FIG. 1) and on bearing blocks 18 and 19, which are put together to form a wall frame 20. In this first assembly 7, the support members 5 and the guide elements 4 are viewed as a dismountable unit or assembly 13 in that the bearing blocks 18, 19, which extend parallel to the plane of symmetry 2, and thus the wall frame 20, form an upper support bearing and, with two leaf spring assemblies as guide elements 4, an additional, lower support bearing, which is centrally arranged in each case. The outer mounting bearings for the guide elements 4 are mounted on a cover plate 21 with a support plate 22, and the continuous casting mold 1 is held on these plates by means of guide bars 23.

The bearing blocks 18, 19, which together form the single-piece wall frame 20, are supported and mounted on an intermediate plate 17. The wall frame 20 has openings 20*a* that provide access to the mold narrow side 1*a*.

Below the first assembly 7, which comprises the cover plate 21 and the support plate 22 with guide bars 23 for the continuous casting mold 1, there is a stationary assembly 24, which comprises a base plate 15, support walls 16 and an intermediate plate 17 and is supported on a detachable bearing plate 14 that is stationary on the continuous casting frame. Free spaces 25 for the oscillating movements of the guide elements 4 in the form of leaf springs are provided on both sides on this stationary assembly 24, i.e., on the intermediate plate 17 (cf. FIGS. 2, 3, and 4).

Figure 4:
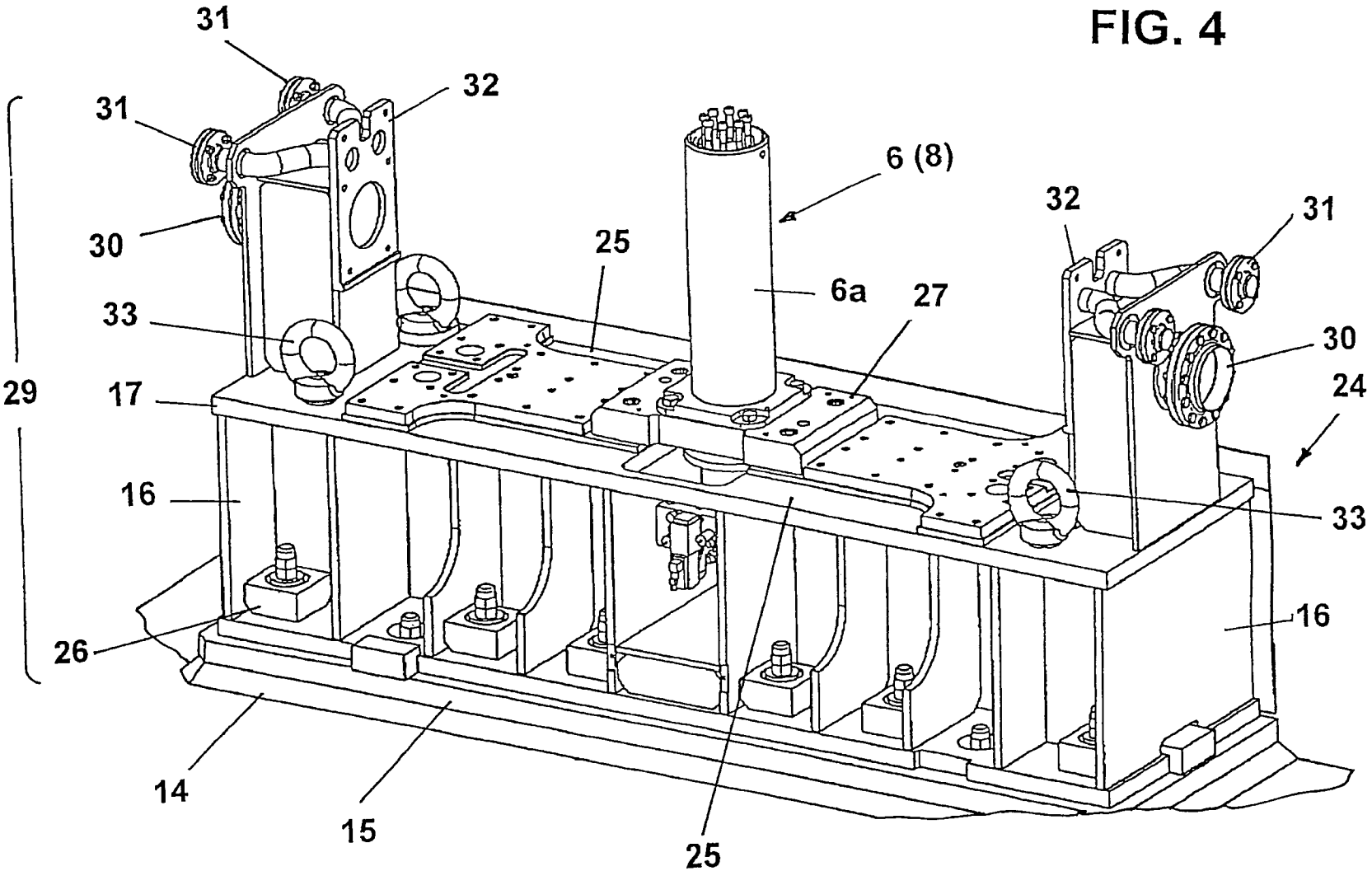
FIG. 4 is a perspective view of the part of the device that normally remains stationary during maintenance, dismounting, and mounting.

The stationary assembly 24 is mounted on the stationary bearing plate 14 by means of base bolts 26 (FIG. 4).

In the illustrated embodiment (FIGS. 2 to 4), the oscillation device 6 is supported in the boundary region between the first dismountable assembly 7 and the stationary assembly 24. As a result, when the first assembly 7 has been dismounted, the accessibility to the piston-cylinder drive 6*a* and the control and switching elements 28 is facilitated to the extent that dismounting of the second dismountable assembly 8 is not always necessary.

According to FIG. 4, a stationary mounting structure 29 with cooling water connections 30 and 31 is provided on the intermediate plate 17. The cooling water connections 30, 31 are each led to a water connection plate 32, which is mounted on the intermediate plate. If necessary, the entire stationary mounting structure 29 can be detached as an assembly with the stationary base plate 15 and the intermediate plate 17 with the mounting structures 29 and can be lifted or set down by crane by means of lifting eyebolts 33.

LIST OF REFERENCE NUMBERS

1 continuous casting mold
1*a* mold narrow side
2 plane of symmetry
3 central longitudinal axis of the cast strand
4 guide elements
5 support members
6 oscillation device
6*a* piston-cylinder drive
7 first dismountable assembly
8 second dismountable assembly
9 outlet or inlet
9*a* guideway
10 extension
11 bearing block
12 bearing block
13 dismountable unit
14 stationary bearing plate
15 base plate
16 support wall
17 intermediate plate
18 bearing block
19 bearing block
20 wall frame
20*a* openings
21 cover plate
22 support plate
23 guide bar
24 stationary assembly
25 free space
26 base bolt
27 flange plate
28 control and switching elements
29 stationary mounting structure

30 cooling water connection (feed)
31 cooling water connection (return)
32 water connection plate
33 lifting eyebolt

The invention claimed is:

1. A device for supporting and oscillating a continuous casting mold (1) for casting molten metal, where, on each side of a plane of symmetry (2) that contains the central longitudinal axis (3) of the cast strand, the device has:

a first assembly, which comprises a guide element (4) that is supported on two stationary support members; and a second assembly (8), which comprises an oscillation device (6), wherein the continuous casting mold (1) is supported on each side of the plane of symmetry (2) on the respective guide element (4) and the respective oscillation device (6) and can be caused to oscillate by means of the oscillation device, wherein on each side of the plane of symmetry (2), the oscillation device (6) can be moved laterally into or out of the first assembly by means of a guideway (9*a*), which is located below the guide element (4) and extends transversely to the plane of symmetry (2), the guideway (9*a*) has a T-slot, and at its end facing the guideway (9*a*), the oscillation device (6) has a flange plate that engages the T-slot.

2. A device in accordance with claim 1, wherein the first assembly (7), together with extensions (10) of a self-supporting continuous casting mold (1), is supported and mounted by means of the guide elements (4) on spaced bearing blocks (11, 12).

* * * * *